US005544489A

United States Patent [19]

Moren

[11] Patent Number: 5,544,489

[45] Date of Patent: Aug. 13, 1996

[54] DISPENSING APPARATUS FOR A COOLED LIQUID WITH THERMOELECTRIC PROBE

[75] Inventor: Ulf Moren, San Rafael, Calif.

[73] Assignee: Coolworks, Inc., San Rafael, Calif.

[21] Appl. No.: 378,540

[22] Filed: Jan. 26, 1995

[51] Int. Cl.[6] ..... F25B 21/02

[52] U.S. Cl. ..... 62/3.64; 62/3.7; 62/183; 165/299

[58] Field of Search ..... 62/3.2, 3.3, 3.64, 62/3.7, 183, 139, 393, 389, 397; 165/39, 40

[56] References Cited

U.S. PATENT DOCUMENTS

| | | | |
|---|---|---|---|
| 2,943,452 | 7/1960 | Buchanan | 62/183 |
| 3,178,896 | 4/1965 | Sandsto | 62/3.64 |
| 4,320,626 | 3/1982 | Donnelly | 62/3.64 |
| 4,934,150 | 6/1990 | Fessler | 62/139 |
| 4,993,229 | 2/1991 | Baus | 62/3.64 |
| 5,367,879 | 11/1994 | Doke et al. | 62/3.64 |

*Primary Examiner*—John M. Sollecito
*Attorney, Agent, or Firm*—David Fink

[57] ABSTRACT

The invention relates to an apparatus for dispensing a cooled liquid, comprising a receptacle defining a compartment and having a wall with a hole defined in it; a thermoelectric device operable for producing a first surface having a relatively cool temperature and a second surface having a relatively elevated temperature, and a heat sink means adjacent to the second surface and operable for removing heat from the second surface to reduce its temperature. A thermally conductive probe is in direct physical contact with the first surface of the thermoelectric device and extends through the hole in the wall. The first surface has substantially complete physical contact with the probe. A connecting arrangement urges and maintains direct physical contact between the probe and the first surface. A sealing arrangement maintains the probe positioned through the hole in the wall while inhibiting any leaking of the liquid through the hole.

9 Claims, 3 Drawing Sheets

DISPENSING APPARATUS FOR A COOLED LIQUID WITH THERMOELECTRIC PROBE

FIELD OF THE INVENTION

The invention relates generally to dispensers for a liquid such as water, and more specifically to a dispensing apparatus for a cooled liquid.

DESCRIPTION OF THE PRIOR ART

Liquid dispensers are well known and in widespread use. Most known water dispensers simply provide a tap to a potable water line or a replaceable bottle of water that selectively delivers a flow of water at ambient room temperature (uncooled) through a valve to the consumer. Other water dispenser systems provide heating and/or cooling to the water, typically by conventional devices such as heat coil and/or refrigeration techniques.

Thermoelectric modules are used to cool the water in a water dispenser. As used herein, a "thermoelectric device" refers to a known device which responds to a direct current input by having one side relatively cooled and another side relatively heated. A typical arrangement in the prior art has a thermoelectric device in a cooled water dispenser simply placed with the cold side of the thermoelectric device adjacent the water receptacle (e.g., the water bottle) to produce cooled water. This is not an economical way to cool the water in the receptacle because the transfer of energy is inefficient.

U.S. Pat. No. 4,993,229 to Baus et al. discloses a bottled water cooling unit in the form of a thermoelectric device positioned externally relative to a water receptacle. It is evident that this arrangement is particularly poor for transferring heat from the water in the water receptacle because the wall of the water receptacle acts as an insulating layer to reduce the transfer of thermal energy.

U.S. Pat. No. 4,320,626 to Donnelly discloses a portable beverage chiller/warmer using an immersion element extending from the opening at the top of a container for cooling or heating. The immersion element interferes with the addition of water from the top so Donnelly must physically remove his immersion element to add water. Moreover, if ice formed on the immersion element, Donnelly might not even be able to remove the immersion element to add water. Donnelly use of an immersion element to communicate directly into the liquid through the top opening in the container differs significantly from the Baus et al. patent. The arrangement disclosed by Donnelly does not contribute greatly to efficient mixing or generation of conduction currents in the water to distribute the temperature changes throughout the water in the container.

Donnelly discloses a pair of thermoelectric devices space apart from each other and in contact with a portion of the surface of the immersion element to communicate cooling to the immersion element. This arrangement is inherently inefficient because heat from the hot sides of the thermoelectric devices can adversely interact with the cool sides through a path between the thermoelectric elements as well as around them.

SUMMARY OF THE INVENTION

The present invention overcomes the disadvantages of the prior art by providing a cooled liquid dispenser featuring an efficient transfer of thermal energy between a thermoelectric device to liquid to be cooled within a container using a probe in direct uninterrupted contact with the thermoelectric device.

It is an object of the invention to provide a cooled liquid dispenser to communicate thermally from the thermoelectric device to the liquid through a wall of the container to achieve convection currents in the liquid to mix the liquid to obtain uniformity of cooling throughout the liquid.

It is another object of the invention to provide a cooled liquid dispenser having an optimum thermal contact between the thermoelectric device and the probe through the use of a pressure contact arrangement.

It is a further object of the invention to provide a cooled liquid dispenser to form ice on the probe selectively to provide inherent temperature regulation of the liquid by storing cooling energy and also to provide insulation from the communicating of additional cooling energy to limit the amount of ice formed.

It is yet a further object of the invention to provide a cooled liquid dispenser which adjusts to reduced ambient temperatures economically.

It is still a further object of the invention to provide a cooled liquid dispenser capable of cooling a liquid on a continuous basis even if the liquid is moving.

The invention in a broad embodiment relates to an apparatus for dispensing a cooled liquid, comprising a receptacle defining a compartment and having a wall with a hole defined in it; a thermoelectric device operable for producing a first surface having a relatively cool temperature and a second surface having a relatively elevated temperature, and a heat sink means adjacent to the second surface and operable for removing heat from the second surface to reduce its temperature. A thermally conductive probe is in direct physical contact with the first surface of the thermoelectric device and extends through the hole in the wall. The first surface has substantially complete physical contact with the probe. A connecting arrangement urges and maintains direct physical contact between the probe and the first surface. A sealing arrangement maintains the probe positioned through the hole in the wall while inhibiting any leaking of the liquid through the hole.

Preferably, the heat sink means includes fins connected to the second surface for dissipating thermal energy. It is also desirable to have blowing means operable for moving air near the fins to move heated air for cooling the second surface. It is also desirable to use the cooling means to control the temperature of the first surface such as allowing the temperature of the second surface to rise so that the cooling of the probe becomes limited.

The invention also features a control arrangement to reduce the operation of the thermoelectric device when the ambient temperature is less than a predetermined temperature. In one arrangement, the operation of the cooling means is reduced when the ambient temperature is below the predetermined temperature.

Another embodiment of the invention relates to a method using the components of the apparatus and operating the cooling to allow the formation of ice on the probe and retaining the ice on the probe so that the ice can be used to enhance the cooling of the liquid. The formation of the ice on the probe is carried out so that newly added liquid to the compartment can be efficiently cooled.

DETAILED DESCRIPTION OF THE PREFERRED EMBODIMENTS

Figure 1:
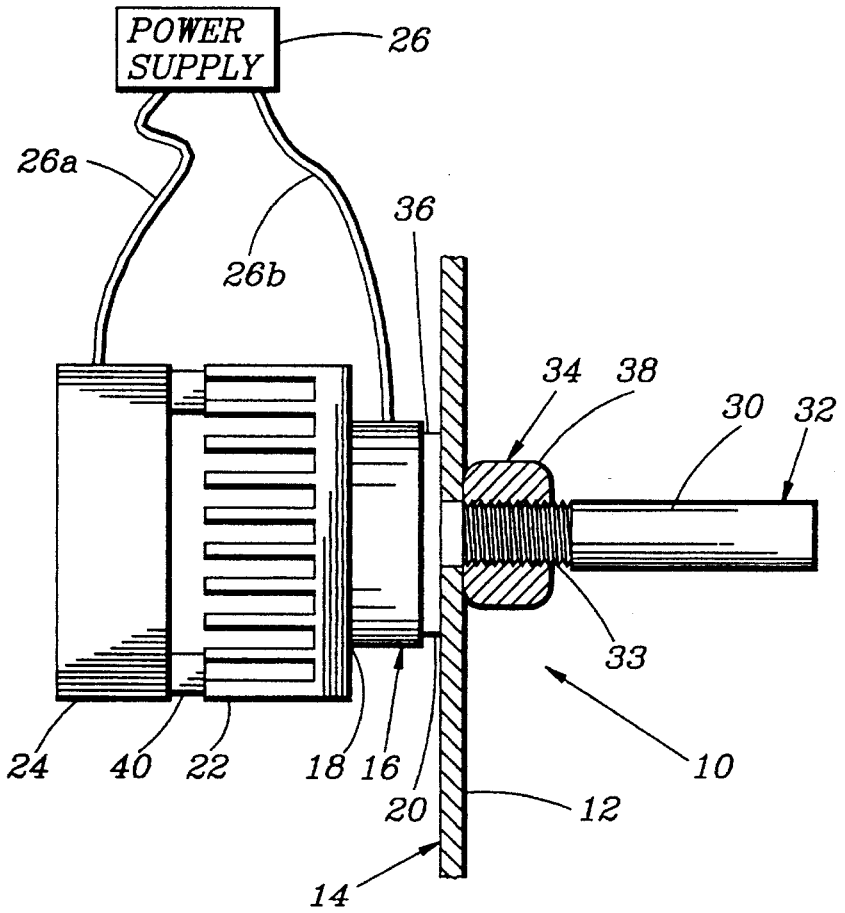
FIG. 1 is a side elevational view partially in section with portions removed (to simplify the figure) of a dispensing apparatus according to the invention.
Figure 2:
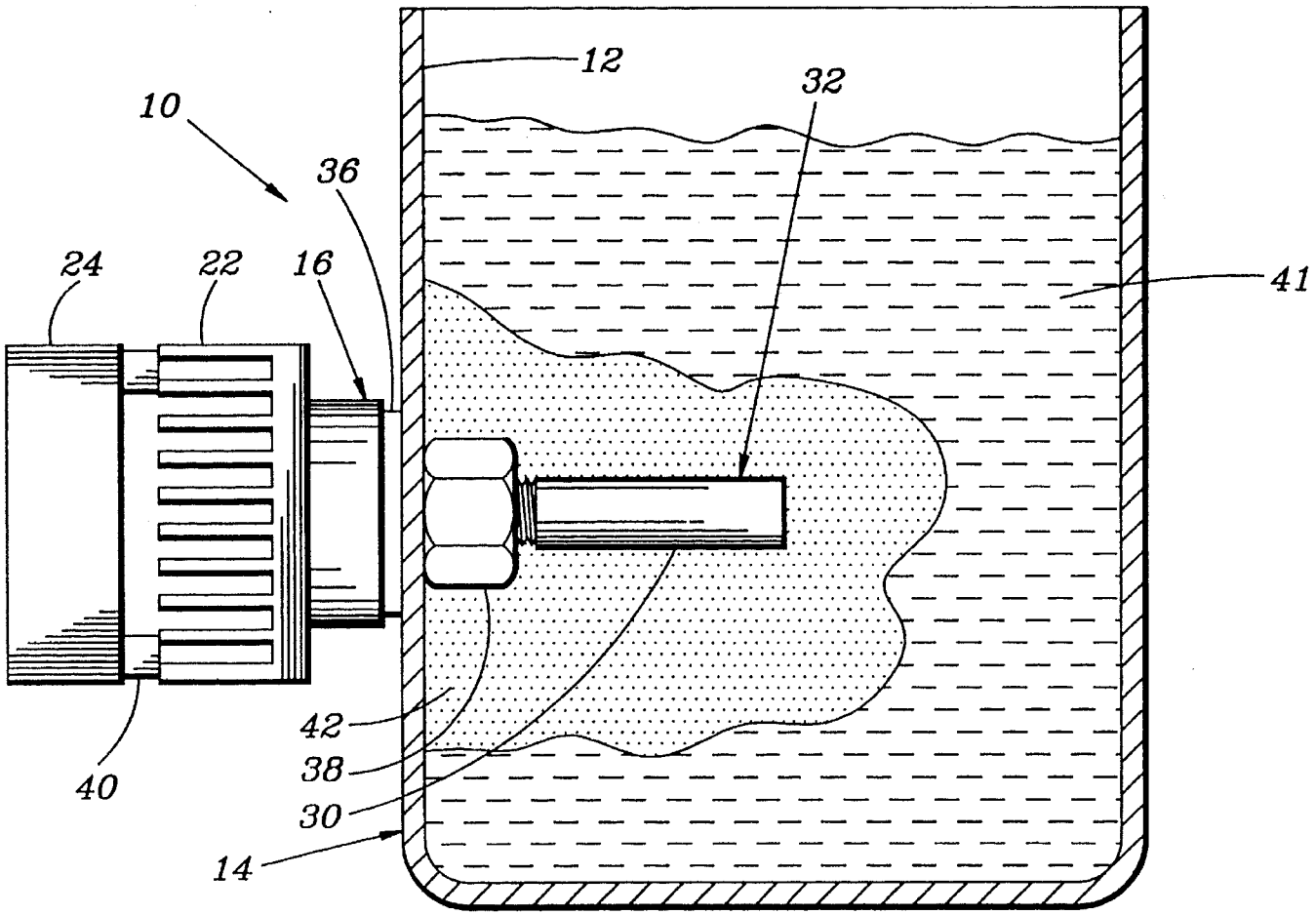
FIG. 2 is a side elevational view partially in section with portions removed (to simplify the figure) of the dispensing apparatus shown in FIG. 1 under certain operating conditions.

Referring to FIGS. 1 and 2, an apparatus 10 according to the invention is shown. A wall 12 of a receptacle 14 has the apparatus 10 incorporated through the wall 12. The apparatus 10 is designed to be used through the wall 12 because it is particularly advantageous to have cooling from a position which will produce a striking temperature differential in a liquid 41, thereby generating currents in liquid 41 so that movement of the liquid 41 produces mixing of the cooled portions with other portions without requiring a mechanical mixer. In addition, positioning the apparatus 10 through the wall 12 allows an opening used to supply liquid such as an opening at the top, to be used to add liquid without disturbing the apparatus 10. Thus, liquid can be conveniently added even if the apparatus 10 is ladened with ice.

The apparatus 10 has a cold sink 32 for producing a reduced temperature to cool the liquid 41. Typically, the liquid 41 is water, it could be some other substance as long as it is compatible with the invention and the components in contact with the liquid 41. The cold sink 32 has a probe 30 made of a highly thermally conductive material such as a metal compatible with and relatively non-reactive with the liquid 41. Suitable metals include aluminum, copper, and stainless steel. A suitable protection can be added to the metal such as anodizing the aluminum, or using a protective coating, or a protective sleeve of a non-reactive material.

Figure 3:
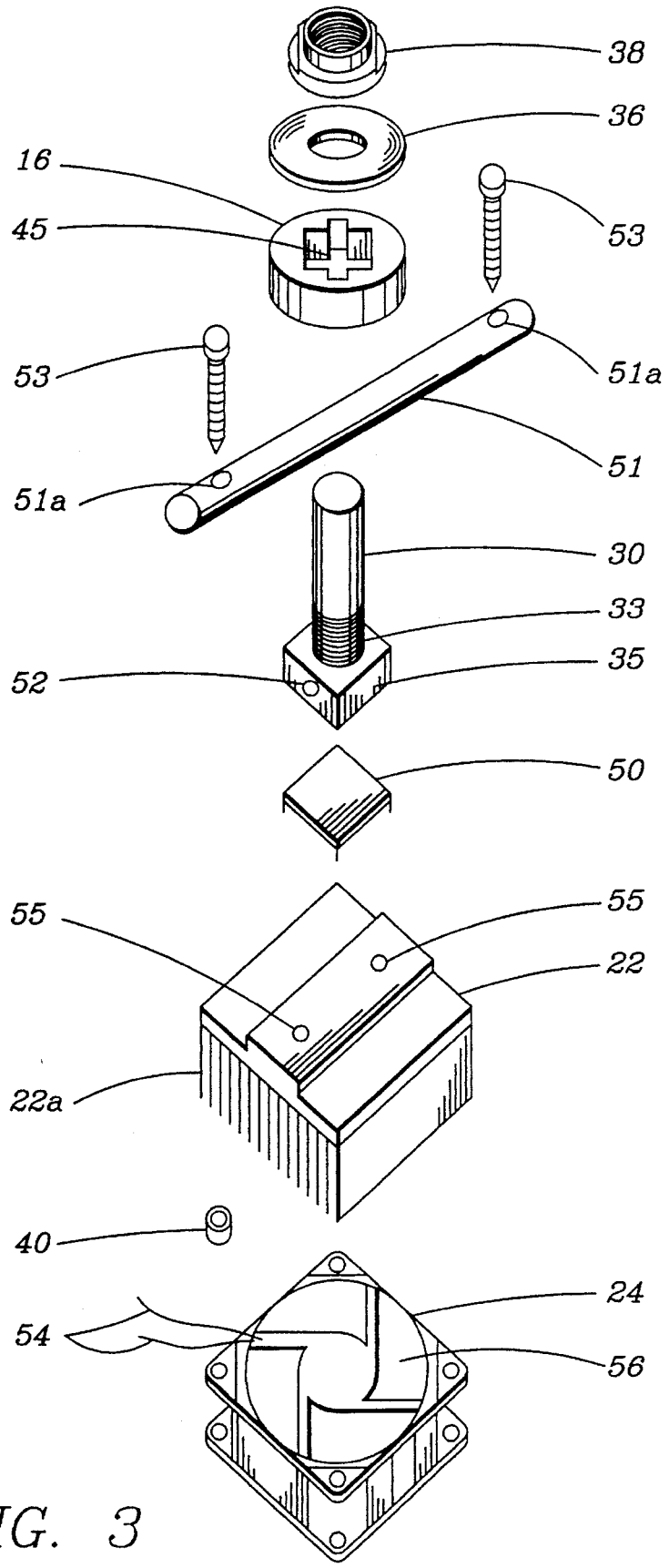
FIG. 3 is an exploded view of a portion of the dispensing apparatus shown in FIG. 1 with some components omitted to simplify the figure.

As shown in FIG. 3, the probe 30 has a threaded portion 33 and a base 35. The base 35 is shaped to engage a thermoelectric device 50 substantially fully. Preferably, the base 35 and the thermoelectric device 50 are substantially identical to minimize energy loss. The thermoelectric device 50 is a commercially available device which produces a reduced temperature on one side and a raised temperature on the other side when a direct voltage is applied to the device.

The thermoelectric device 50 is arranged so that in FIG. 1 cold side 20 is facing the liquid 41 and hot side 18 is facing a heat sink 22. The heat sink 22 engages the thermoelectric device 50 fully so that heat produced by the thermoelectric device can be selectively removed efficiently and effectively.

It is important to achieve a firm physical contact between the thermoelectric device 50 and both the cold sink 32 and the heat sink 22. Furthermore, this goal should not be at the risk of creating a potential path for leakage of the liquid 41 as in the case of the prior art. In addition, in the prior art, the arrangement of an apparatus for cooling is preferentially through the top opening of a receptacle to minimize leakage completely.

One of the features of the invention is connecting means for physically urging the heat sink 22, thermoelectric device 50 and cold sink 32 together mechanically while avoiding the introduction of a potential path for leakage. The base 35 has a hole 52 through it and connecting pin 51 is engaged in the hole 52 with holes 51*a* positioned on each side of the base 35. Bolts 53 pass through respective holes 51*a* and engage respective holes 55. The connecting pin 51 can be made of metal or non-metal because there is ample thermal conductive paths around the hole 52.

An electrically non-conductive, thermally insulating body 16 has a cut-out 45 to allow it to be positioned so that one flat surface contacts the base 35 so that the contact between the base 35 and the thermoelectric device 50 is insulated against external temperature influences. In addition, the insulating body 16 provides a relatively soft surface for contact with the outside surface of the wall 14.

The probe 30 extends through a hole in the wall 14 into the liquid 41 and is maintained in its position by a nut 38 which screws onto the threaded portion 33 and has a washer 36 pressing against the outside surface of the wall 14. The washer 36 can be made of silicone, PVC or some other suitable material and seals the hole in the wall 14 against leakage.

Figure 5:
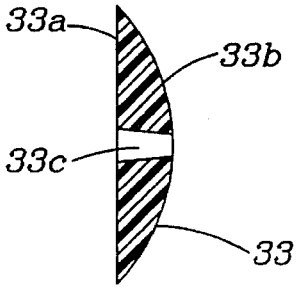
FIG. 5 shows a sectional view of a washer preferable for use in the apparatus shown in FIG. 1.

It is preferable to position the washer 36 on the outside surface of the wall 14 to form a reliable seal against leakage rather than positioning the washer 36 on the inside surface because the threaded portion 33 would not interact with the washer 33 to distort it into a shape forming a satisfactory seal. Preferably, the washer 36 has a shape as shown in FIG. 5 in which the surface 33*a* abutting the surface of the base 35 is substantially flat while the surface 33*b* is curved away from the wall 14 so that pressure during the tightening of the nut 38 distorts the washer 33 to form a very reliable seal. It is also preferable to have the hole 33*c* generally conical with the larger end at surface 33*a* and the smaller end at 33*b*. The smaller end is substantially the size compatible with the threaded portion 33; however, it can be slightly larger than the threaded portion 33 and still form a reliable seal.

The heat sink 22 is a conventional thermally conductive material with fins 22*a* for dissipating heat. A commercially available fan 24 with blade 56 is arranged in confronting relationship to the heat sink 22 and spaced away by spacers 40. The wires 54 are for the input of electrical power into the fan 24. The fan 24 blows air to cool the fins 22*a* because the cooling of the thermoelectric device 50 is diminished if the hot side 18 is too hot. The heat sink 22 is matched to the fan 24 to maximize the heat transfer away from the thermoelectric device 50. Preferably, the fan 24 is selected to have relatively low noise.

The fan 24 and thermoelectric device 50 are connected to a power supply 26 through lines 26*a* and 26*b* respectively in accordance with conventional practices.

One of the numerous advantages of the apparatus according to the invention is that the arrangement of components exhibits inherent controls favorable to optimum efficiency. As the temperature differential between the liquid 41 and the ambient air outside the receptacle 14 increases, the amount of cooling from the thermoelectric device 50 to the probe 30 declines. When ice 42 forms on the probe 30, the thermal exchange between the probe 30 and the liquid 41 is reduced because of the insulating properties of the ice 42. These two factors along with inadvertent thermal losses contribute to the control of the amount of ice 42 which can form under the range of typical operating ambient conditions.

Figure 4:
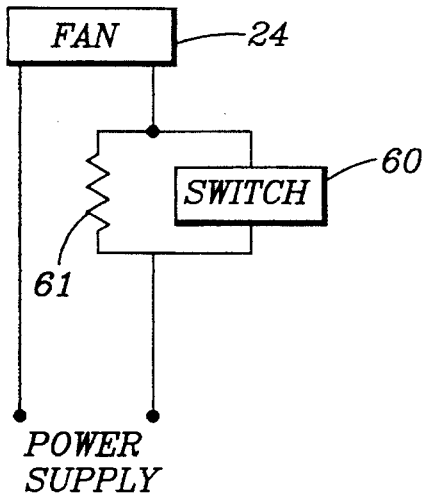
FIG. 4 shows a modification of the electrical circuit associated with the apparatus shown in FIG. 1 for controlling the operation of the apparatus.

If the ambient temperature can be less than some predetermined value such as 50° F., then some additional control may be desirable. FIG. 4 shows a simple and commercially attractive arrangement for limiting the growth of ice 42 on the probe 30. The fan 24 has input electrical lines 54 connected to a temperature sensitive switch 60 such as a commercially available bi-metal switch which is ordinarily closed and a resistor 61 in parallel arrangement having a typical value of from 50–60 ohms.

During the operation of the apparatus 10 above the predetermined ambient temperature, the switch 60 is closed and highly conductive. When the ambient temperature is less then the predetermined temperature, the switch 60 becomes substantially electrically non-conductive so that the electrical path is through the resistor 61. The greater resistance of the path through the resistor 61 reduces the power delivered to the fan 24, thereby reducing the effective blowing of the fan 24. The increase in the heat at the hot side 18 tends to reduce the amount of cooling on the cold side 20. Hence, less ice 42 is formed.

A temperature sensor can be used to control the formation of ice in several arrangements other than measuring ambient temperature. The temperature sensor can be arranged to measure the temperature of the heat sink 22 or the liquid 41. In addition, a circuit can be used to measure the amount of ice 42 formed to limit the amount of ice 42 being formed.

The invention has the advantage of allowing cooling for the liquid 41 to be stored in the form of ice 42 on the probe 30 and this storage of ice 42 is self-regulating. Thus, ice 42 formed during non-working hours can be used to assist in cooling the liquid 41 during working hours when the demand for cooled liquid 41 peaks.

There has been described a novel system and process. It is evident that those skilled in the art may now make numerous uses and modifications of and departures from the specific embodiments described herein without departing from the inventive concepts. Consequently, the invention is to be construed as embracing each and every feature and novel combination of features present or possessed by the system and process herein disclosed and limited solely by the spirit and scope of the appended claims.

What is claimed is:

1. An apparatus for dispensing a cooled liquid, comprising a receptacle defining a compartment for retaining said liquid and having a side wall with a hole defined in it;

a thermoelectric device operable for producing a first surface having a relatively cool temperature and a second surface having a relatively elevated temperature;

heat sink means adjacent to the second surface and operable for removing heat from the second surface to reduce the temperature of the second surface;

a thermally conductive probe in direct physical contact with the first surface of said thermoelectric device and extending through the hole in said wall;

said first surface being substantially in complete physical contact with said probe;

connecting means operable for urging and maintaining direct physical contact between said probe and the first surface of said thermoelectric device; and sealing means disposed within said container operable for maintaining said probe positioned through the hole in the wall while inhibiting any leaking of the liquid through the hole in said wall.

2. The apparatus as claimed in claim 1, wherein said heat sink means comprises a fan operable to blow air near the second surface of said thermoelectic device.

3. The apparatus as claimed in claim 2, wherein said fan is responsive to the electrical power delivered to it and heat sink means further comprises temperature sensing means operable for changing the electrical power delivered to said fan for controlling the amount of cooling of said thermoelectric device to the liquid.

4. The apparatus as claimed in claim 3, wherein said connecting means comprises a member engaged into said probe, and attaching means operable for attaching said member to said heat sink without penetrating said thermoelectric device.

5. An apparatus for dispensing a cooled liquid, comprising a receptacle defining a compartment and having a wall with a hole defined in it;

a thermoelectric device operable for producing a first surface having a relatively cool temperature and a second surface having a relatively elevated temperature;

heat sink means adjacent to the second surface and operable for removing heat from the second surface to reduce the temperature of the second surface;

a thermally conductive probe in direct physical contact with the first surface of said thermoelectric device and extending through the hole in said wall;

said first surface being substantially in complete physical contact with said probe; connecting means operable for urging and maintaining direct physical contact between said probe and the first surface of said thermoelectric device; and sealing means operable for maintaining said probe positioned through the hole in the wall while inhibiting any leaking of the liquid through the hole in said wall;

said probe including a portion threaded and said sealing means comprising a nut means operable for engaging the threaded portion of said probe and a washer positioned between said wall and said probe.

6. The apparatus as claimed in claim 5, wherein said washer has a flat surface on the side engaging said probe and has a curved shape away from said wall on the side facing said wall, whereby said washer is distorted during the tightening of said nut means to provide a reliable seal.

7. The apparatus as claimed in claim 6, wherein said washer has a hole defined in it for said receiving said probe and said washer hole is conically shaped with a large diameter on the side near said wall relative to the side near the abutting surface of said probe.

8. The apparatus as claimed in claim 5, further comprising control means operable for limiting the amount of ice formed on said probe to be less than a predetermined amount, whereby the ice formed constitutes stored cooling for cooling said liquid economically.

9. The apparatus as claimed in claim 5, wherein the first surface of said thermoelectric device is substantially the same surface area as the surface area of said probe in direct contact with it.

* * * * *